US010167154B2

(12) United States Patent
Barberan Latorre

(10) Patent No.: US 10,167,154 B2
(45) Date of Patent: Jan. 1, 2019

(54) VACUUM SYSTEM FOR SECURING ITEMS IN PRINTING MACHINES

(71) Applicant: Jesus Francisco Barberan Latorre, Castelldefels Barcelona (ES)

(72) Inventor: Jesus Francisco Barberan Latorre, Castelldefels Barcelona (ES)

( * ) Notice: Subject to any disclaimer, the term of this patent is extended or adjusted under 35 U.S.C. 154(b) by 144 days.

(21) Appl. No.: 15/125,230

(22) PCT Filed: Mar. 11, 2015

(86) PCT No.: PCT/ES2015/070171

§ 371 (c)(1),
(2) Date: Sep. 12, 2016

(87) PCT Pub. No.: WO2015/136137

PCT Pub. Date: Sep. 17, 2015

(65) Prior Publication Data

US 2018/0170073 A1 Jun. 21, 2018

(30) Foreign Application Priority Data

Mar. 14, 2014 (ES) ..... 201430353

(51) Int. Cl.
*B65H 5/22* (2006.01)
*B65H 11/00* (2006.01)
(Continued)

(52) U.S. Cl.
CPC ..... *B65H 11/005* (2013.01); *B41J 3/28* (2013.01); *B41J 11/0085* (2013.01);
(Continued)

(58) Field of Classification Search
CPC ..... B65H 5/224; B65H 11/005; B65H 2301/44735; B65H 2403/52;
(Continued)

(56) References Cited

U.S. PATENT DOCUMENTS 4,312,694 A 1/1982 Sherman et al.
5,133,543 A * 7/1992 Eitel ..... B65H 5/24 271/197
(Continued)

FOREIGN PATENT DOCUMENTS

EP 2610064 A1 7/2013
ES 2310490 A1 1/2009
WO 2008136823 A1 11/2008

OTHER PUBLICATIONS

International Search Report dated Apr. 14, 2015 for PCT/ES2015/070171 and English translation.
Written Opinion dated Apr. 14, 2015 for PCT/ES2015/070171 (Spanish only).
Written Opinion dated Apr. 14, 2015 for PCT/ES2015/070171—English translation.

*Primary Examiner* — Jeremy R Severson
(74) *Attorney, Agent, or Firm* — Lucas & Mercanti, LLP

(57) ABSTRACT

The invention relates to a vacuum system for securing items in printing machines, comprising a printing table (2) with a perforated surface and, in relation thereto, a vacuum system for securing the items to be printed, which comprises a box structure (8) connected to a suction system and provided with a perforated wall in relation to the surface of the printing table (2), said box structure (8) having lateral panels that vertically close the interior thereof, which panels can be moved in order to adjust the gap between them in relation to the width of the items to be printed.

3 Claims, 6 Drawing Sheets

(51) Int. Cl.
*B41J 3/28* (2006.01)
*B41J 11/00* (2006.01)

(52) U.S. Cl.
CPC ... *B65H 5/224* (2013.01); *B65H 2301/44735* (2013.01); *B65H 2403/52* (2013.01); *B65H 2406/3124* (2013.01); *B65H 2406/322* (2013.01); *B65H 2406/3221* (2013.01); *B65H 2406/3222* (2013.01); *B65H 2406/362* (2013.01); *B65H 2406/3622* (2013.01)

(58) Field of Classification Search
CPC ..... B65H 2406/3124; B65H 2406/322; B65H 2406/3221; B65H 2406/3222; B65H 2406/362; B65H 2406/3622
See application file for complete search history.

(56) References Cited

U.S. PATENT DOCUMENTS

| | | | | |
|---|---|---|---|---|
| 6,582,072 | B1 | 6/2003 | Wotton et al. | |
| 7,293,770 | B2 * | 11/2007 | Edinger | B65H 11/005 198/689.1 |
| 8,157,369 | B2 * | 4/2012 | Hoover | B41J 11/06 347/104 |
| 9,302,874 | B2 * | 4/2016 | Schilling | B65H 29/242 |
| 2010/0213666 | A1 | 8/2010 | Harney et al. | |
| 2011/0292145 | A1 | 12/2011 | Hoover et al. | |

* cited by examiner

VACUUM SYSTEM FOR SECURING ITEMS IN PRINTING MACHINES

CROSS REFERENCE TO RELATED APPLICATIONS

This Application is a 371 of PCT/ES2015/070171 filed on Mar. 11, 2015, which, in turn, claimed the priority of Spanish Patent Application No. P201430353 filed Mar. 14, 2014, both of which are incorporated herein by reference.

FIELD OF THE ART

The present invention relates to processes of printing on rigid or semi-rigid surfaces by means of propelling an ink, proposing a vacuum application system for securing the items to be printed on the tables of printing machines, such that said vacuum does not affect the inks that are propelled for printing, allowing the automatic adaptation to different sizes of the items to be printed.

STATE OF THE ART

The contact technique by means of printing rollers, as well as the contactless technique by means of ink propelling heads are known for printing on rigid or semi-rigid surfaces, the contactless technique offering greater precision and quality, as well as more application possibilities since the print colors are obtained by combining individually propelled inks.

The practice of securing items to be printed on the table of printing machines by means of applying a vacuum through the table itself, which can be fixed or can be a conveyor belt, is also known. To that end, such practice means that the table of printers has a perforated support surface for supporting the items in order to apply through same vacuum for securing the items.

However, the items to be printed can have a smaller width than the surface of the support table, whereby in the lateral areas not covered by the item of application an absorption effect occurs due to the vacuum which can cause the inks propelled onto the item to be printed to be diverted, leading to printing imperfections on the item and the loss of some of the inks that are propelled.

Solutions have been developed to counteract that problem, such as, for example, patent document ES 2310490, which cancels the actuation of the vacuum in the areas not covered by the items being printed on the tables of the printers by means of arranging plugs for the perforations in the tables below the lateral areas of the perforated surface of the tables on which the items to be printed are arranged, so the actuation of the vacuum is focused only under the item placed on the table, thereby preventing the detrimental effects caused by the suction. This solution is effective, but it requires adjusting the position of the plugs every time the width of the items to be printed changes, which requires operator intervention, making the printing process slow and expensive.

OBJECT OF THE INVENTION

The present invention proposes a vacuum application system in tables of printing machines, with an arrangement that automatically cancels the actuation of the vacuum in the lateral areas not covered by the items to be printed, preventing the detrimental effect of the vacuum for printing, as well as losses of inks that are wasted, in addition to accelerating and simplifying the transition when printing on items having different widths.

According to the invention, under the perforated surface of the support table of the items to be printed there is arranged a vacuum system comprising a box structure connected through suction nozzles with a suction system, the interior of the box structure having lateral panels for vertically closing said box arranged in a sliding assembly for moving transversally in the box structure, with a drive system for said panels comprising a motor associated with a transmission shaft actuating a series of screws moving the mentioned lateral panels for vertically closing the box structure closer to and farther away from one another. Additionally, in the inlet area for positioning the items to be printed on the support table in the printing machine, there is arranged a detection system that determines the passage of the leading edge and the trailing edge of the length of the items, as well as the width thereof.

Therefore, every item to be printed is arranged on the table of the printing machine, entering from a feed system, such that when said item passes through the detection system said system determines the length and width of the item from the passage of the leading edge thereof in order to transmit coordinates that allow precisely controlling the propelling of the printing inks on the item, as well as controlling the drive for placing the lateral panels for vertically closing the vacuum box structure in the position corresponding to the width of the item, the action of the vacuum through the perforated table thereby being limited to the area on which the item is supported.

With this system, the vacuum application area for securing the items to be printed is therefore automatically adjusted depending on the control of the dimensions of the items when they pass through the detection system at the inlet into the printing machine, thereby preventing manual intervention every time the size of the items to be printed changes and reducing the operative time of printing processes since waiting times for adjusting the vacuum application area in the support table of the items to be printed are not required. This results in a cost reduction, in addition to providing a much more reliable adjustment precision than when adjusted manually.

Therefore, said vacuum application system object of the invention has clearly advantageous features, being novel and preferred with respect to other known vacuum application systems having the same application.

DETAILED DESCRIPTION OF THE INVENTION

Figure 1:
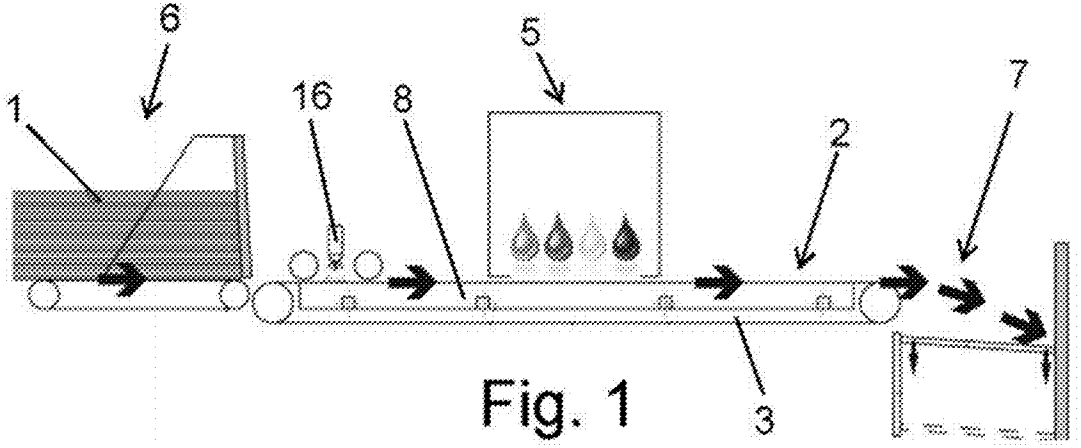
FIG. 1 shows a side elevational schematic view of an embodiment of a printing machine provided with the vacuum system object of the invention.
Figure 2:
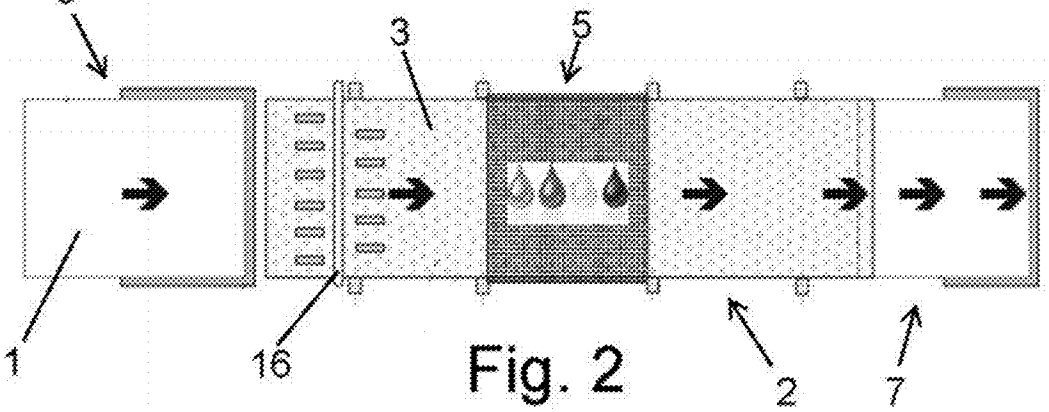
FIG. 2 shows a corresponding plan view with respect to the preceding figure.
Figure 3:
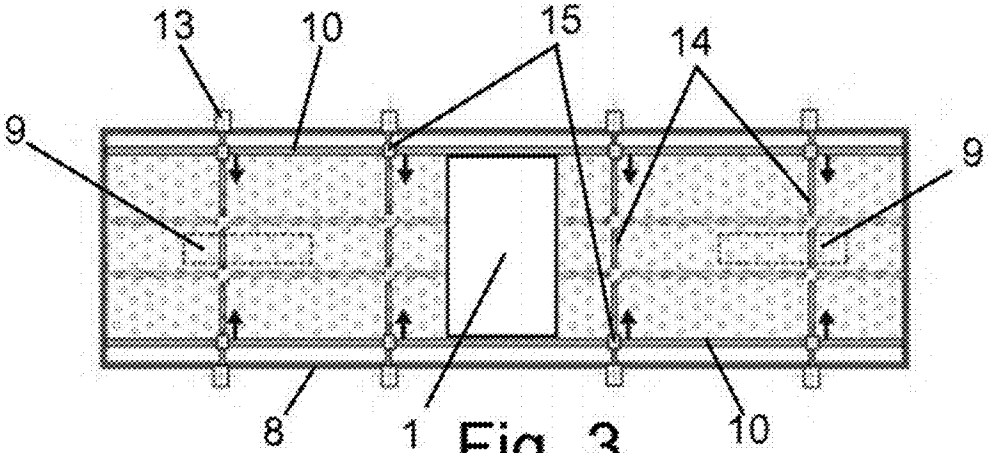
FIGS. 3 and 4 show respective schematic plan views of the box structure of the vacuum system of the invention in respective positions for regulating application of the vacuum for items having two different widths.
Figure 4:
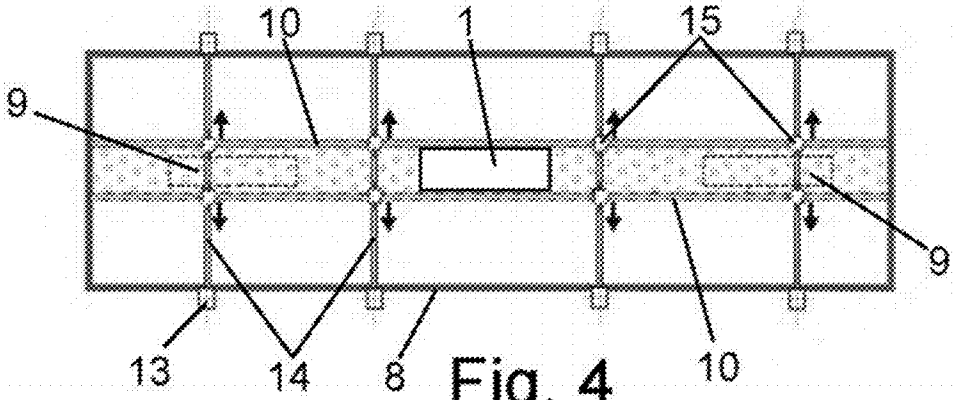
Figure 5:
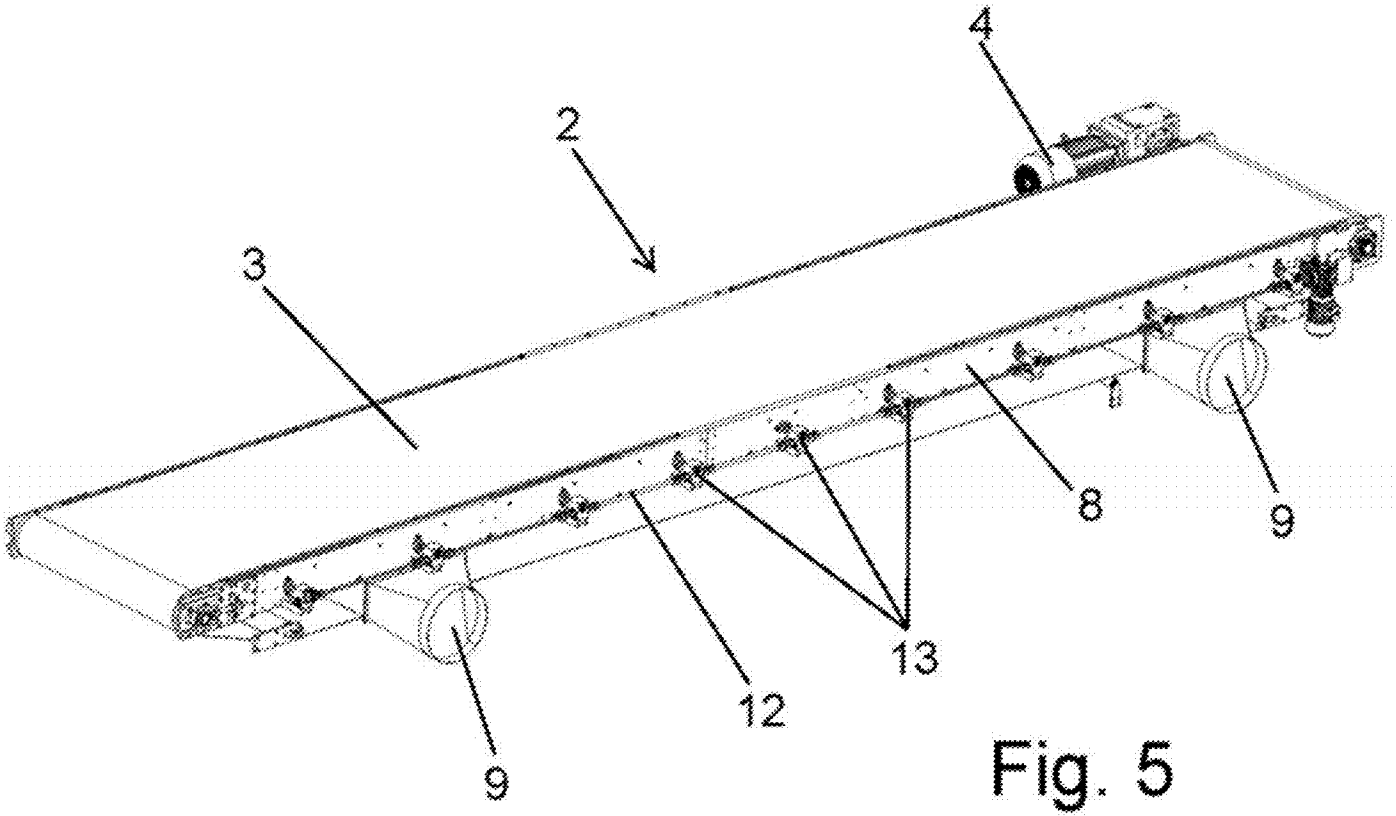
FIG. 5 shows a perspective view of an embodiment of a printing table with the vacuum system object of the invention.
Figure 6:
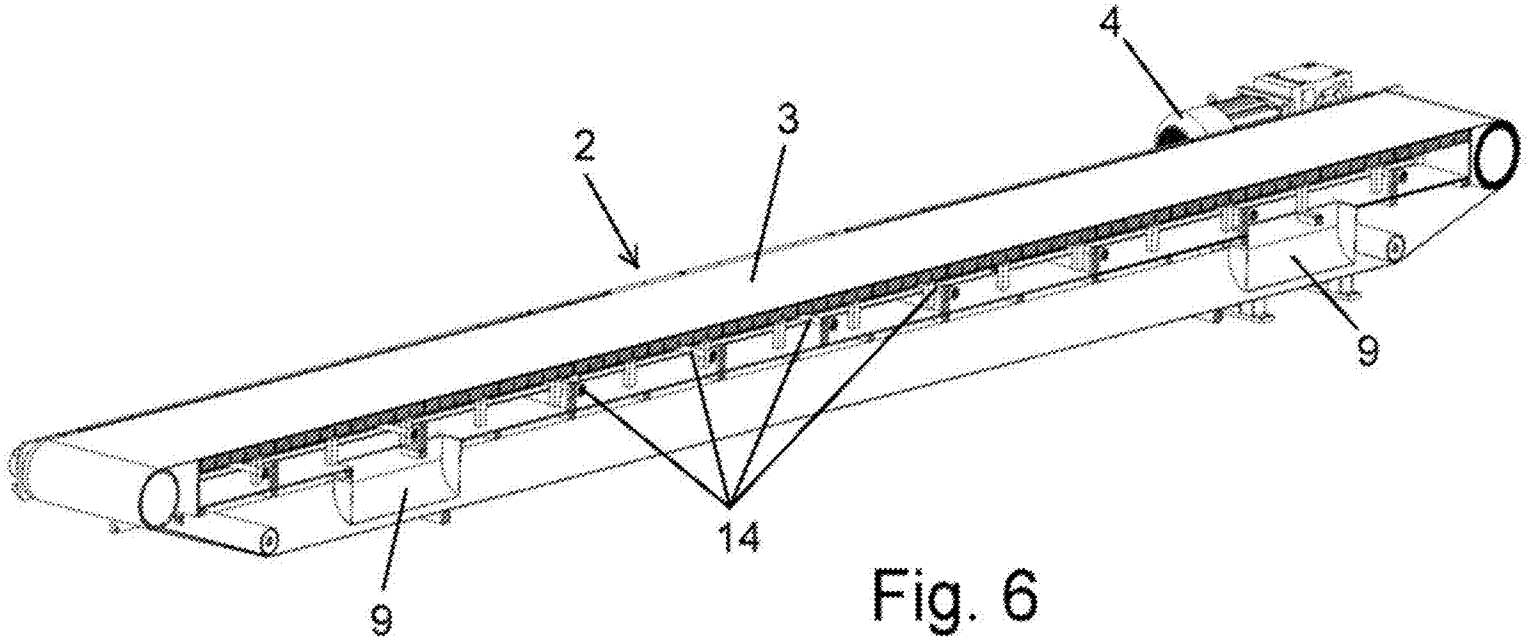
FIG. 6 shows a perspective longitudinal section view of the printing table in the preceding figure.
Figure 7:
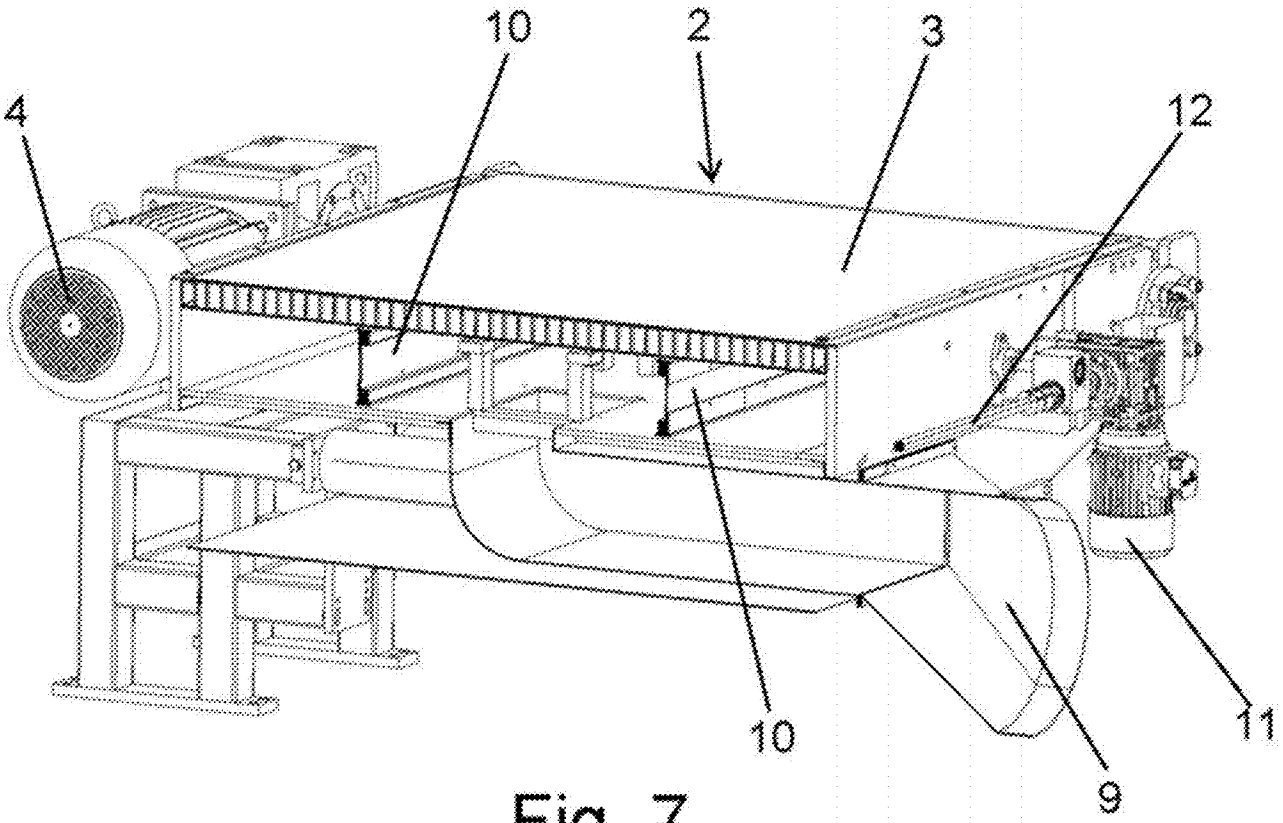
FIG. 7 shows an enlarged cross-section view of the same printing table, according to a corresponding section through the area of a nozzle of the suction system.
Figure 8:
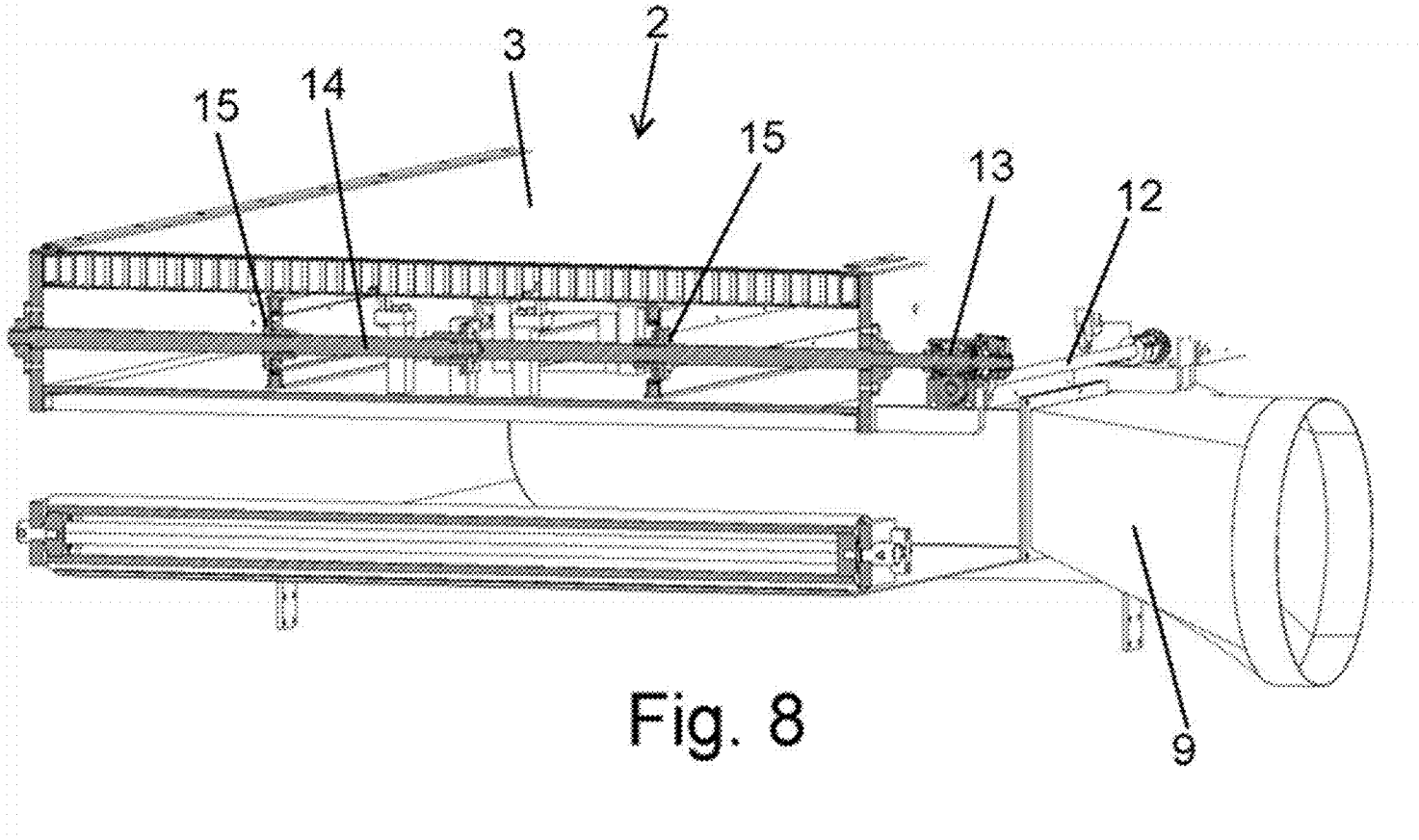
FIG. 8 shows a cross section of the printing table through an area corresponding to a screw for moving the lateral partitions for vertically closing the vacuum box structure.

The present invention relates to a vacuum system for securing items (1) in printing machines, for example of the type comprising a printing table (2) formed by a conveyor belt (3) which is operated by a drive motor (4) and determines a perforated support surface for supporting the items (1) to be printed, there being arranged above said printing table (2) a printing ink propelling system (5), whereas a vacuum system is arranged below the perforated support surface for supporting the items (1) to be printed; there being arranged in front of the printing table (2) a feed system (6) for feeding the items (1) to be printed, which can be independent items or a continuous sheet, and there being arranged behind said printing table (2) a delivery system (7) for delivering the printed items (1).

The vacuum system comprises a box structure (8) connected by means of nozzles (9) with a suction system from the intermediate area of its transversal width, said box structure (8) having an upper perforated face which is located below the perforated surface of the printing table (2) on which the items (1) are arranged for printing, such that the vacuum produced by the suction system in said box structure (8) causes suction through the upper face thereof and through the support surface for supporting the items (1), securing said items (1) on said support surface to keep them in place during the printing process.

Inside the box structure (8) there are arranged lateral panels (10) that vertically close said interior of the box structure (8) in a sealed manner, said lateral panels (10) being incorporated in a sliding assembly for moving the box structure (8) transversally by means of an actuation system, such that said lateral panels (10) can be moved closer to and farther away from one another.

The actuation system for actuating the moving lateral panels (10) that vertically close the box structure (8) comprises a motor (11) driving a transmission shaft (12) arranged on one side along the box structure (8), said transmission shaft (12) being linked by means of couplings (13) with transverse screws (14) associated with the lateral panels (10) of the interior of the box structure (8), in relation to which said screws (14) generate inverse coupling relations, such that when rotated in one direction, they cause said lateral panels (10) to move closer to one another and, by rotation in the opposite direction, they cause said lateral panels (10) to move farther away from one another. To that end, the screws (14) are linked with the lateral panels (10) through threaded couplings (15) having opposite thread directions.

Therefore, in order to adapt the vacuum system in the printing table (2) according to the width of the items (1) to be printed, the screws (14) are driven by means of the motor (11) through the transmission shaft (12), which screws (14) move the lateral panels (10) transversally through the interior of the box structure (8) to the position corresponding with the width of the item (1) arranged on the printing table (2), thereby determining that the action of the vacuum only affects the area covered by the item (1) to be printed, the lateral areas of the surface of the printing table (2) not being covered by the item (1) unless the vacuum is applied therein.

In the inlet area for arranging the items (1) to be printed on the printing table (2), there is arranged a detection system (16) which determines the length, width and position of said items (1) as they pass therethrough, generating coordinates that allow precisely controlling the propelling of the inks for the printing to be done, as well as automatically controlling the positioning of the lateral partitions (10) in the interior of the box structure (8) in order to adjust the vacuum system to the width of the items (1) arranged on the printing table (2) to be printed.

According to a practical embodiment, in order to assure perfect positioning of the items (1) when they are placed on the printing table (2) and to determine precise conditions for securing same as they pass through the printing area and when they are released in the delivery area, it is envisaged that the longitudinal extension of the box structure (8) is divided into three independent successive chambers, each one connected with the suction system by means of one or more nozzles (9), to determine, by means of a control for regulating said suction system, different vacuum pressures in the successive chambers for securing the items (1) in the inlet area where the items are positioned on the printing table (2), greater force being applied than in the printing area and less force being applied in the area where the printed items (1) are removed.

The invention claimed is:

1. A vacuum system for securing items in printing machines, comprising a printing table having a perforated surface, in relation to which there is arranged a vacuum system for securing on said printing table the items to be printed, wherein the vacuum system comprises a box structure connected through nozzles with a suction system from the intermediate area of its transversal width, said box structure having an upper perforated wall opposite the perforated surface of the printing table, whereas in the interior thereof there are arranged lateral panels that vertically close in a sealed manner said interior of the box structure, which lateral panels can be moved transversally to move them closer to and farther away from one another inside the box structure, an actuation system being linked to said panels in order to move them, wherein a longitudinal extension of the box structure is divided into a plurality of independent successive chambers in which different vacuum pressures are applied for securing items to be printed, a first force being applied in an inlet area where the items are positioned on the printing table, a second force weaker than the first force being applied in a printing area where the items are printed, and a third force weaker than the second force being applied in a removal area where the items that are removed after having been printed.

2. The vacuum system for securing items in printing machines according to claim 1, wherein the actuation system for moving the lateral panels comprises a motor driving a transmission shaft which is linked by means of couplings with screws moving the lateral panels.

3. The vacuum system for securing items in printing machines according to claim 1, wherein the drive of the actuation system for moving the lateral panels is controlled automatically depending on the dimensions of the items to be printed by means of coordinates provided by a detection system through which the items pass when they are located on the printing table.

* * * * *